US008800238B2

(12) United States Patent
Davies

(10) Patent No.: US 8,800,238 B2
(45) **Date of Patent: *Aug. 12, 2014**

(54) PORTABLE MODULAR ROOF TRUSS SYSTEM

(75) Inventor: Charles J. Davies, Pasadena, CA (US)

(73) Assignee: Global Truss America, LLC, Los Angeles, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/806,735

(22) PCT Filed: Jun. 14, 2011

(86) PCT No.: PCT/US2011/040371

§ 371 (c)(1),
(2), (4) Date: Dec. 21, 2012

(87) PCT Pub. No.: WO2011/163015

PCT Pub. Date: Dec. 29, 2011

(65) Prior Publication Data

US 2013/0118110 A1 May 16, 2013

Related U.S. Application Data

(63) Continuation of application No. 12/822,521, filed on Jun. 24, 2010, now Pat. No. 8,627,633.

(60) Provisional application No. 61/269,586, filed on Jun. 26, 2009.

(51) Int. Cl.

| | |
|---|---|
| ***E04H 12/00*** | (2006.01) |
| ***E04B 7/02*** | (2006.01) |
| ***E04H 15/44*** | (2006.01) |

(52) U.S. Cl.

CPC ..... *E04B 7/022* (2013.01); *E04H 15/44* (2013.01)

USPC ..... 52/653.2; 52/641; 52/643; 52/646

(58) Field of Classification Search

USPC ..... 52/633, 641, 643, 645, 646, 650.1, 52/648.1, 650.3, 652.1, 653.2, 655.1, 690; 135/120.3, 909, 121, 122, 160

See application file for complete search history.

(56) References Cited

U.S. PATENT DOCUMENTS

| | | | |
|---|---|---|---|
| 1,181,013 | A | 4/1916 | Ingles |
| 1,420,670 | A | 6/1922 | Schuette |

(Continued)

FOREIGN PATENT DOCUMENTS

| | | | |
|---|---|---|---|
| FR | 2826990 | A1 | 1/2003 |
| WO | 2010151882 | A1 | 12/2010 |

OTHER PUBLICATIONS

International Search Report and the Written Opinion mailed Sep. 1, 2010 for International Application No. PCT/US2010/040227 from the International Searching Authority and United States Commissioner for Patents, pp. 1-9, Alexandria, Virginia, United States.

(Continued)

*Primary Examiner* — William Gilbert
*Assistant Examiner* — James Ference
(74) *Attorney, Agent, or Firm* — Kenneth L. Sherman, Esq.; Michael Zarrabian, Esq.; Sherman & Zarrabian LLP

(57) ABSTRACT

The present invention provides a portable modular roof truss system. In one embodiment, a portable modular roof truss system comprises at least one roof truss device comprising a roof apex collar, a crossbar, two arms, and two connecting members. The collar comprises two separate members coupled together by at least one bolt to form an opening capable of receiving a roof pole. In another embodiment, a portable modular roof truss system comprises two roof apex collars. In yet another embodiment, a roof truss device comprises a collar, a crossbar, two arms, and two connecting members. The collar comprises two separate members coupled together by a hinge to form an opening capable of receiving a roof pole.

23 Claims, 14 Drawing Sheets

(56) References Cited

U.S. PATENT DOCUMENTS

| | | | | |
|---|---|---|---|---|
| 1,568,099 | A | 1/1926 | Strauss | |
| 1,837,374 | A | 12/1931 | Rene | |
| 1,840,745 | A | 1/1932 | Shoaf | |
| 2,187,436 | A | 1/1940 | Thofehrn | |
| 2,201,504 | A | 5/1940 | Ruppel | |
| 2,334,435 | A | 11/1943 | Patterson et al. | |
| 2,693,195 | A | 11/1954 | Frieder et al. | |
| 2,764,107 | A | 9/1956 | Niswonger et al. | |
| 2,826,990 | A | 3/1958 | Gross | |
| 2,845,078 | A | 7/1958 | Singleton | |
| 2,897,831 | A | 8/1959 | Liden | |
| 2,936,186 | A * | 5/1960 | Dunmire | 285/373 |
| 3,058,540 | A | 10/1962 | Anderson | |
| 3,062,340 | A | 11/1962 | Hunnebeck | |
| 3,114,377 | A | 12/1963 | Clement | |
| 3,172,507 | A | 3/1965 | Blyveis | |
| 3,296,752 | A | 1/1967 | Philip | |
| 3,303,851 | A | 2/1967 | Grunfeld | |
| 3,383,127 | A | 5/1968 | Grunfeld | |
| 3,418,768 | A | 12/1968 | Cardan | |
| 3,424,178 | A | 1/1969 | Yazaki | |
| 3,436,881 | A | 4/1969 | Schlecht | |
| 3,441,037 | A | 4/1969 | Transeau | |
| 3,456,415 | A | 7/1969 | Shaffer | |
| 3,582,029 | A * | 6/1971 | Moesta | 248/68.1 |
| 3,766,573 | A | 10/1973 | Burkholz et al. | |
| 3,925,942 | A | 12/1975 | Hemmelsbach | |
| 4,030,256 | A | 6/1977 | Ollman | |
| 4,246,730 | A | 1/1981 | Hulscher | |
| 4,641,477 | A | 2/1987 | Schleck | |
| 4,653,782 | A | 3/1987 | Munday | |
| 4,683,901 | A | 8/1987 | Mitchell | |
| 4,769,962 | A | 9/1988 | Pohl et al. | |
| 4,878,286 | A | 11/1989 | Coppa | |
| 4,961,297 | A | 10/1990 | Bernard | |
| 5,076,031 | A | 12/1991 | Hancock | |
| 5,078,534 | A | 1/1992 | White | |
| 5,159,790 | A | 11/1992 | Harding | |
| 5,167,246 | A | 12/1992 | Mortenson | |
| 5,205,101 | A | 4/1993 | Swan et al. | |
| 5,309,693 | A | 5/1994 | Harding | |
| 5,388,376 | A | 2/1995 | Demeyer | |
| 5,584,311 | A | 12/1996 | Schaefer | |
| 5,592,789 | A | 1/1997 | Liddell, Sr. et al. | |
| 5,623,786 | A | 4/1997 | DeMeyer | |
| 5,660,002 | A | 8/1997 | Lashinger | |
| 5,822,945 | A | 10/1998 | Muller | |
| 5,826,384 | A | 10/1998 | O'Neill | |
| 5,964,068 | A | 10/1999 | O'Neill | |
| 6,026,626 | A | 2/2000 | Fisher | |
| 6,065,267 | A | 5/2000 | Fisher | |
| 6,076,770 | A | 6/2000 | Nygren et al. | |
| 6,079,178 | A | 6/2000 | Fisher | |
| 6,082,068 | A | 7/2000 | Fisher | |
| 6,170,503 | B1 | 1/2001 | Lin Shy | |
| 6,212,850 | B1 | 4/2001 | Branson | |
| 6,321,501 | B1 | 11/2001 | Ignash | |
| 6,609,343 | B1 * | 8/2003 | Litten | 52/653.2 |
| 6,618,988 | B2 | 9/2003 | Williams et al. | |
| 6,626,605 | B1 | 9/2003 | Dean et al. | |
| 6,675,546 | B2 | 1/2004 | Coles | |
| 6,691,488 | B2 | 2/2004 | Branson | |
| 6,832,448 | B2 | 12/2004 | Stefan | |
| 6,857,246 | B2 | 2/2005 | Erbetta et al. | |
| 7,028,442 | B2 | 4/2006 | Merrifield | |
| 7,146,995 | B2 | 12/2006 | Lapping | |
| 7,275,555 | B2 | 10/2007 | Powell et al. | |
| 7,533,498 | B2 | 5/2009 | Zeigler | |
| 7,690,698 | B1 * | 4/2010 | Curran | 285/367 |
| 7,694,486 | B2 | 4/2010 | Murphy et al. | |
| 7,716,897 | B2 | 5/2010 | Merrifield | |
| 7,770,591 | B2 | 8/2010 | Tseng | |
| 7,963,084 | B2 | 6/2011 | Merrifield et al. | |
| 7,988,386 | B2 | 8/2011 | Sisk | |
| 8,006,462 | B2 | 8/2011 | Murphy et al. | |
| 8,011,162 | B2 | 9/2011 | Overby | |
| 8,028,488 | B2 | 10/2011 | Dodd | |
| 2002/0170588 | A1 | 11/2002 | Seo | |
| 2004/0035454 | A1 | 2/2004 | Tseng | |
| 2008/0178555 | A1 | 7/2008 | Green et al. | |

OTHER PUBLICATIONS

International Search Report and Written Opinion dated Oct. 21, 2011 for International Application No. PCT/US2011/040371 from the International Searching Authority and United States Commissioner for Patents, pp. 1-13, Alexandria, Virginia, United States.

International Preliminary Report on Patentability and Written Opinion dated Jan. 12, 2012 for International Application No. PCT/US2010/040227 from the International Bureau of WIPO, pp. 1-7, Geneva, Switzerland.

U.S. Non-Final Office Action for U.S. Appl. No. 12/822,521 mailed Mar. 20, 2012.

U.S. Final Office Action for U.S. Appl. No. 12/822,521 mailed Aug. 10, 2012.

U.S. Advisory Action for U.S. Appl. No. 12/822,521 mailed Oct. 16, 2012.

U.S. Non-Final Office Action for U.S. Appl. No. 12/822,521 mailed Nov. 16, 2012.

International Preliminary Report on Patentability and Written Opinion dated Jan. 10, 2013 for International Application No. PCT/US2011/040371 from the International Bureau of WIPO, pp. 1-12, Geneva, Switzerland.

U.S. Final Office Action for U.S. Appl. No. 12/822,521 mailed Feb. 26, 2013.

U.S. Notice of Allowance for U.S. Appl. No. 12/822,521 mailed Sep. 9, 2013.

U.S. Non-Final Office Action for U.S. Appl. No. 12/822,521 mailed Jun. 4, 2013.

* cited by examiner

PORTABLE MODULAR ROOF TRUSS SYSTEM

This application is the U.S. National Phase Patent Application under 35 U.S.C. §371 of International Application Number PCT/US2011/040371 (published as WO 2011/163015 A1), filed on Jun. 14, 2011. International Application Number PCT/US2011/040371 is a continuation-in-part of, and claims priority to, U.S. patent application Ser. No. 12/822,521 filed on Jun. 24, 2010, which in turn claims priority from U.S. Provisional Patent Application Ser. No. 61/269,586, filed on Jun. 26, 2009. These applications, International Application Number PCT/US2011/040371, U.S. patent application Ser. No. 12/822,521 and U.S. Provisional Patent Application Ser. No. 61/269,586 are incorporated herein by reference in their entirety.

BACKGROUND OF THE INVENTION

1. Field of the Invention

The present invention relates generally to truss systems, and in particular, to a portable modular roof truss system.

2. Description of Related Art

Trusses provide general purpose skeletal structures designed to support lighting and audio equipment for live stages, theatres, night clubs, church installations, and other mobile applications. Trusses generally include a variety of different modular truss elements or members that can be interconnected to build structures of different shapes and forms by a designer to independently create whichever lighting, audio or other affect or appearance may be desired.

Typically, each of the truss members are modular and can be connected together and dismantled quickly. The modular members may include square truss members, triangular truss members, I-beam truss members, clamps, box truss members, circular truss members, lifts/lifters, junction blocks, truss corners, towers, sleeve blocks, couplers and clamps among others. The truss members generally run about 0.5 meters in length and are either straight lengths or circular arcs and have connectors to mate the members together.

Oftentimes the same structure must be recreated many times in different places. For example, in a rock and roll touring show the truss work and stage effects must be created and recreated in different places along the tour. On other occasions, the structures are created once and then dismantled. For example, a trade show or political convention will be designed in a particular manner for a particular venue and for an audience at the venue. Then, once the show or convention is complete, the trusses are dismantled and the members are reused in other applications later. In any case, once the trusses are in place they must also be strong and permanent for usage without concerns about the structural performance when they are in place.

BRIEF SUMMARY OF THE INVENTION

Embodiments of the present invention provide a portable modular roof truss system for assembling a roof, such as a symmetric roof, from truss members. In one embodiment, the portable modular roof truss system comprises a collar, a crossbar, two arms, two connecting members, and a locking mechanism. The arms are elongated hollow cylinders coupled to opposing sides of the collar at a predetermined slope. The crossbar is also an elongated cylinder residing parallel to the ground and is coupled to both arms. Each hollow cylindrical connecting member is coupled to the end of an arm, respectively. Finally, the locking mechanism is coupled to the bottom portion of the collar and prevents a roof pole residing therein from moving back and forth. Each connecting member further comprises two apertures residing on opposite sides of the member used to couple the truss system to a variety of truss components (e.g., spacers, clamps, hinges, etc.).

In another embodiment, the portable modular roof truss system comprises two collars, a crossbar, four arms, four connecting members, two locking mechanisms, and a plurality of filler bars. The arms are elongated hollow cylinders coupled (e.g., welded) to opposing sides of the collars. The crossbar is also an elongated cylinder residing parallel to the ground and is coupled (e.g., welded) to both bottom arms. Each hollow cylindrical connecting member is coupled (e.g., welded) to the end of an arm, respectively. The locking mechanisms are coupled (e.g., welded) to the bottom portion of the collars. Finally, the filler bars are elongated hollow cylinders coupled (e.g., welded) to two arms residing on one side of both collars.

In another embodiment, the collar comprises two separate members. Both members are capable of being coupled together by at least one bolt to form a locking mechanism that engages and prevents a roof pole residing within the collar from moving back and forth.

In yet another embodiment, the collar comprises two separate members hinged together.

Roof poles pass through the collars of the truss system. Said roof poles may pass through a plurality of modular roof truss systems to create a roof of desired length while maintaining a fixed slope.

These and other features, aspects and advantages of the present invention will become understood with reference to the following description, appended claims and accompanying figures.

DETAILED DESCRIPTION OF THE INVENTION

The following description is made for the purpose of illustrating the general principles of the present invention and is not meant to limit the inventive concepts claimed herein. Further, particular features described within can be used in combination with other described features in each of the various possible combinations and permutations. Unless otherwise specifically defined herein, all terms should be given their broadest possible interpretation including meanings implied from the specification as well as meanings understood by those skilled in the art and/or as defined in dictionaries, treatises, etc.

Figure 1:
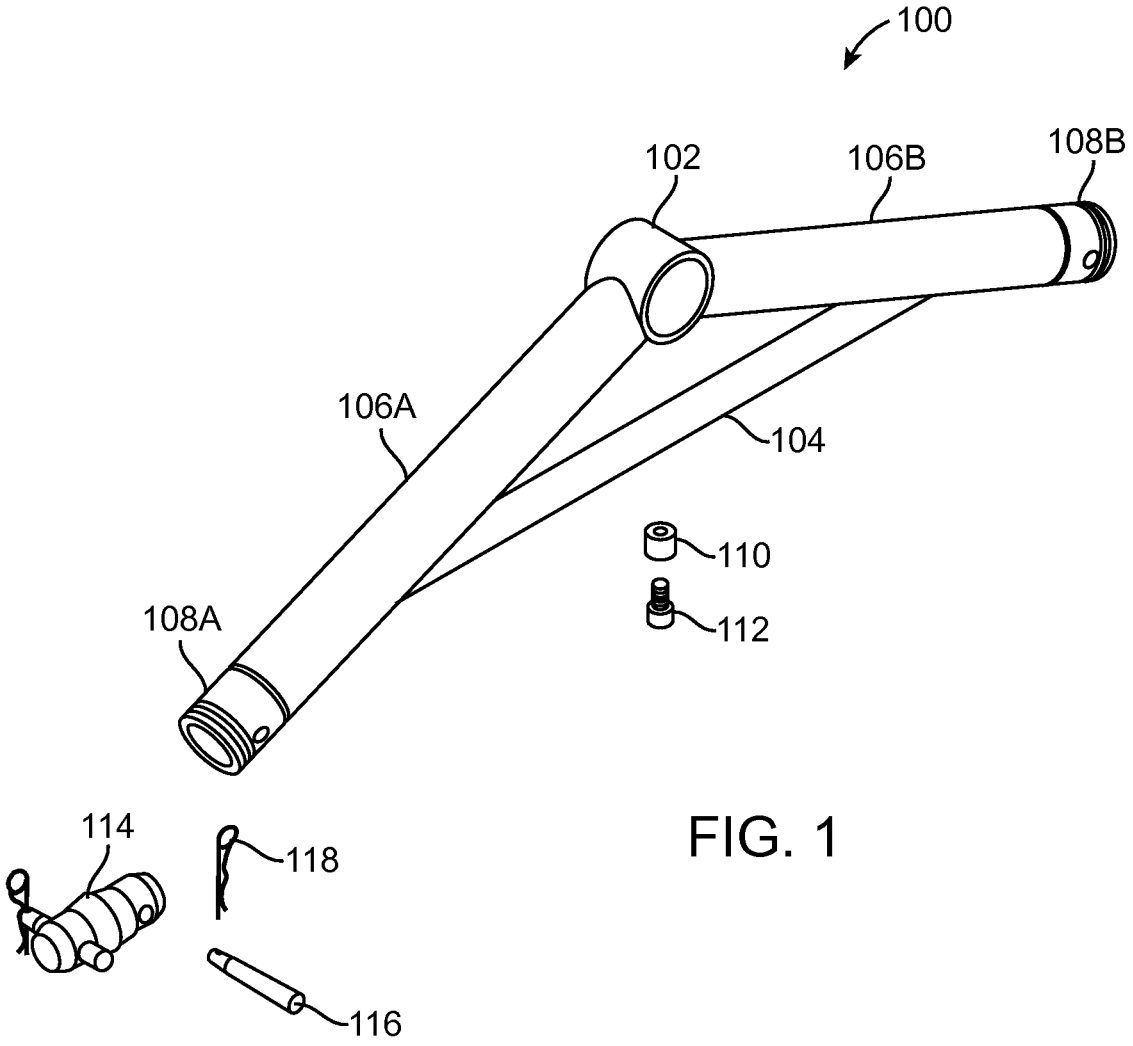
FIG. 1 illustrates a perspective view of a portable modular roof truss system, according to an embodiment of the present invention.

FIG. 1 illustrates a perspective view of a portable modular roof truss system 100, according to an embodiment of the present invention. The portable modular roof truss system 100 comprises a collar 102, a crossbar 104, two arms 106A, 106B, two connecting members 108A, 108B, and a locking mechanism comprising a nut 110 and bolt 112. The arms 106A, 106B, are elongated hollow cylinders coupled (e.g., welded) to opposing sides of the hollow cylindrical collar 102 at a predetermined slope. The crossbar 104 is also an elongated cylinder residing parallel to the ground and is coupled (e.g., welded) to both arms 106A, 106B. Each hollow cylindrical connecting member 108A, 108B, is coupled (e.g., welded) to the end of an arm 106A, 106B, respectively. Finally, the nut 110 from the locking mechanism is coupled (e.g., welded) to the bottom portion of the collar 102 and interfaces an aperture in the collar 102 allowing the bolt 112 to pass through the nut 110 and into the hollow portion of the collar 102. Those skilled in the art will appreciate that the locking mechanism may alternatively reside on the top of the collar 102. Each connecting member 108A, 108B, further comprises two apertures residing on opposite sides of the member perpendicular to the hollow portion of the member used to couple the truss system 100 to a coupler 114. The connecting members 108A, 108B, are capable of coupling to a variety of truss components (e.g., spacers, clamps, hinges, etc.). While the collar, arms, and crossbar mentioned herein are cylindrical in shape, the collar, arms, and crossbar may have different profiles such as elliptical, rectangular, etc.

For example, a coupler 114 may be inserted into the hollow portion of a connecting member 108A; a locking pin 116 may then be inserted through the apertures in the connecting member 108A and in turn through an aperture in the coupler 114. In one embodiment, the locking pin 116 comprises a tapered cylinder with an aperture at smaller end capable of receiving a clasp 118. When the clasp 118 passes through the aperture in the locking pin 116, the coupler 114 is removably coupled to the portable modular roof truss system 100 at the connecting member 108A. The coupler 114 may further removably couple to additional truss components (e.g., I-beam truss segment, straight segment, etc.).

Figure 2A:
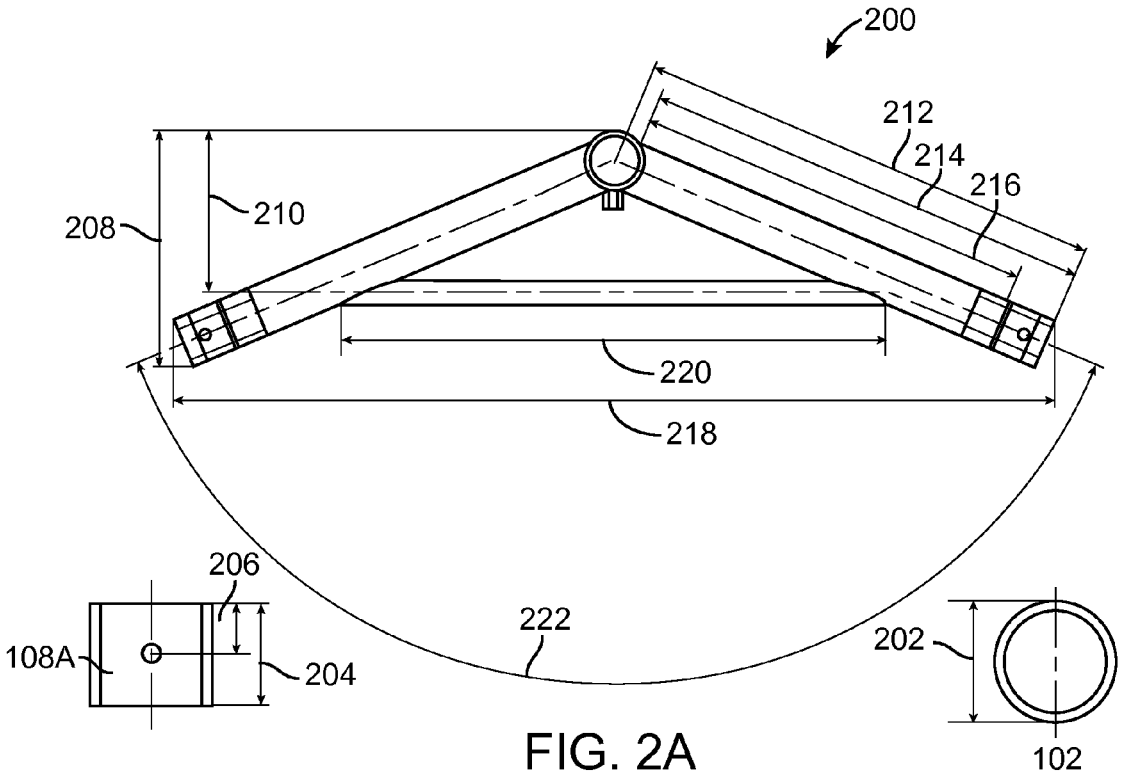
FIG. 2A illustrates a front view of a first portable modular roof truss system, according to an embodiment of the present invention.

FIG. 2A illustrates a front view of a first portable modular roof truss system 200, according to an embodiment of the present invention. The collar of the truss system 100 has a diameter 202 between 46 cm to 56 cm, and preferably 51 cm. Both connecting members have a radius 206 between 20 cm to 30 cm, and preferably 25 cm, with a diameter 204 of preferably 50 cm. The height 208 of the truss system 200, when measured from the bottom edge of the connecting member to the top of the collar is between 215 cm to 225 cm, and preferably 219.8 cm. The height 210 when measured from the top edge of the connecting member to the top of the collar 102 is between 145 cm to 155 cm, and is preferably 150 cm. The length 212 of an arm and connecting member coupled to the collar 102, when measured from the center of the collar 102 to the bottom edge of the connecting member, is between 430 cm to 440 cm, and preferably 435 cm. The length 214 as measured from the top edge of an arm to the bottom edge of a connector member is between 415 cm to 421 cm, and preferably 418.4 cm. Length 216 of the arm alone is preferably 368.4 cm. The length 220 of the crossbar is between 500 cm to 510 cm, and preferably 506 cm with a 1 cm delta. The width 218 of the portable modular roof truss system 200 is between 815 cm to 825 cm, and preferably 821.1 cm. Finally, the angle 222 as measured between the midline of both connector members and through the center of the collar is between 130° to 140°, and preferably 134.8°.

Figure 2B:
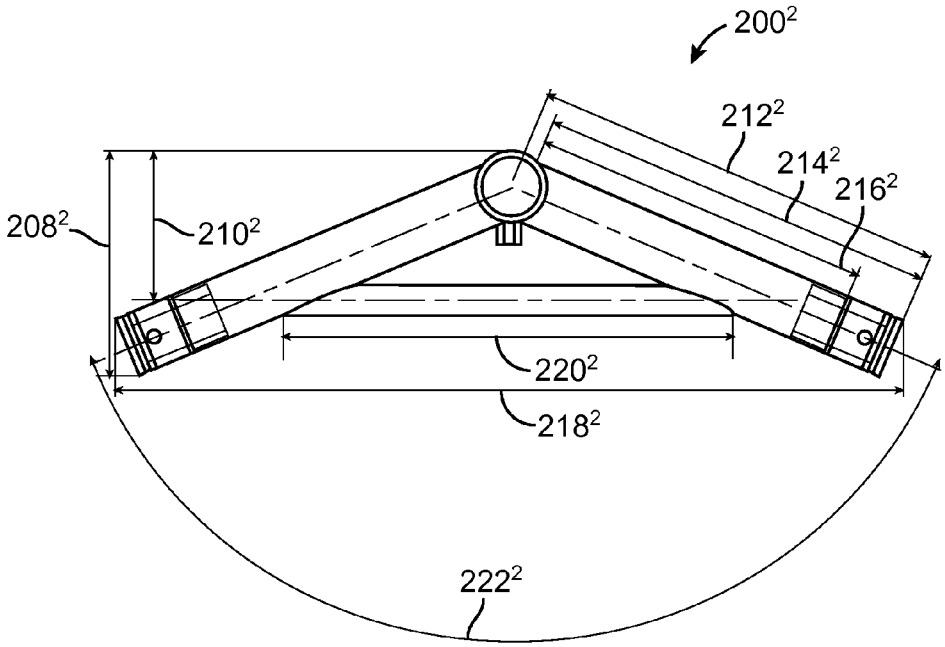
FIG. 2B illustrates a front view of a second portable modular roof truss system, according to an embodiment of the present invention.
Figure 8:
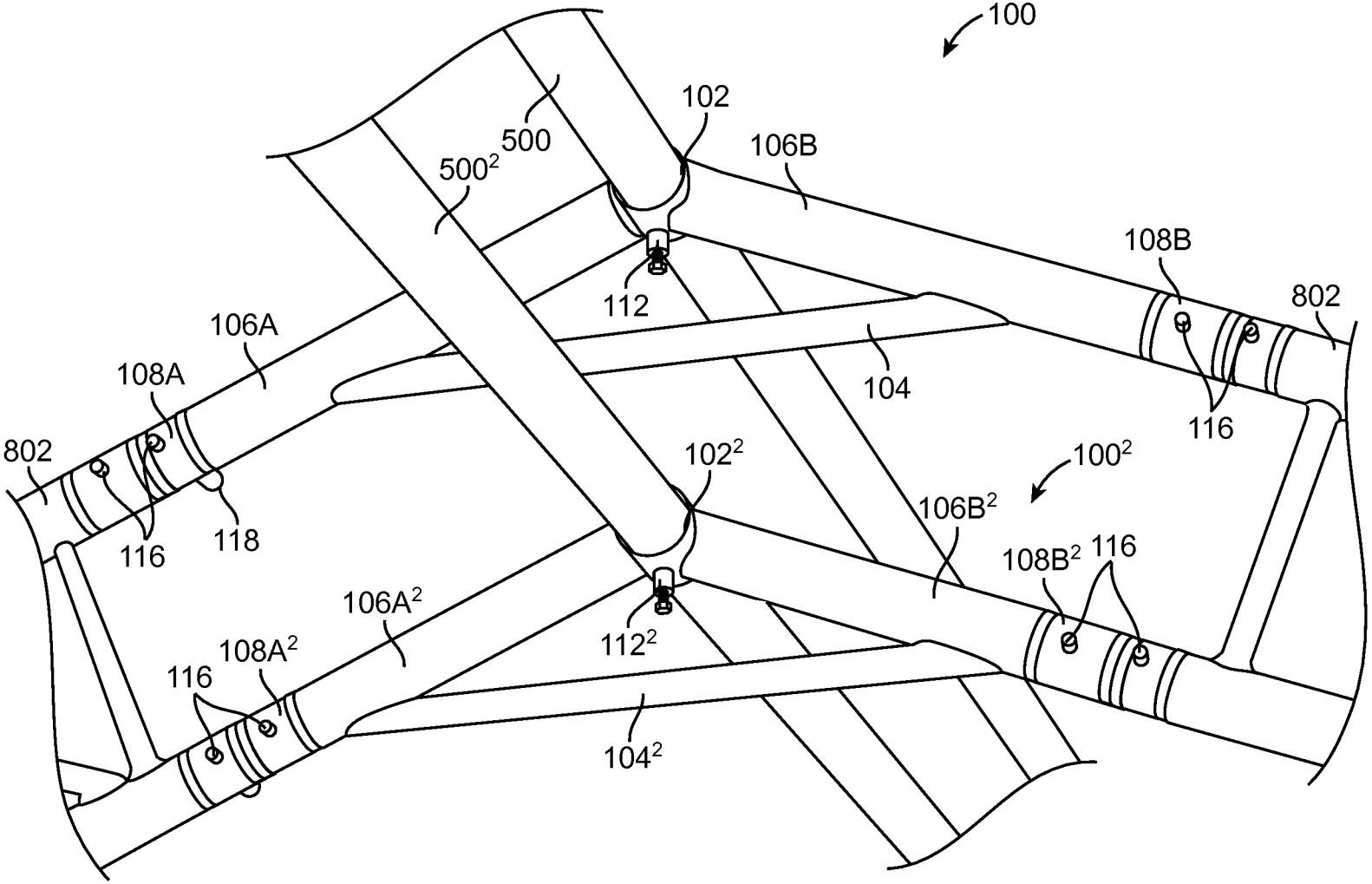
FIG. 8 illustrates a view of assembled modular roof truss systems, according to an embodiment of the present invention.

FIG. 2B illustrates a front view of a second portable modular roof truss system 200$^2$, according to an embodiment of the present invention. In one embodiment, the first truss system 200 and the second truss system 200$^2$ are employed to couple to an I-beam truss segment 802 (FIG. 8). To ensure the first truss system 200 (FIG. 2A) and second truss system 200$^2$ properly engage the I-beam truss segment 802 (FIG. 8), the arms of the second truss system 200$^2$ are shorter in length. Specifically, the length 216$^2$ of the arms in second truss system 200$^2$ are between 265 cm to 270 cm, and preferably 268.4 cm. The shorter arms results in a length 214$^2$ when measured from the top edge of the arm to the bottom edge of the connector member. The length 212$^2$ from the center of the collar to the bottom edge of the connector member is between 330 cm to 340 cm, and preferably 335 cm. The shorter arms also result in a shorter crossbar with a length 220$^2$ between 360 cm to 370 cm, and preferably of 362 cm with a 1 cm delta. The height 208$^2$ from bottom of a connector member to top of the collar is also shorter, between 178 cm to 185 cm, and preferably 181.3 cm. The height 210$^2$ from the bottom edge of the arm to the top of the collar is shorter as well, between 85 cm to 95 cm, and preferably 90 cm. Even the width 218$^2$ of the second portable modular roof truss system 200$^2$ is smaller, between 635 cm to 640 cm, and preferably 636.5 cm. However, the angle 222$^2$ of the second portable modular roof truss system 200$^2$ remains constant with the angle 222 of the first portable modular roof truss system 200 (FIG. 2A), between 130° to 140°, and preferably 134.8°. This ensures the arms in the first portable modular roof truss system 200 are parallel to the arms in the second portable modular roof truss system 200$^2$ and all four arms are capable of coupling to the I-beam truss segment 802 (FIG. 8).

Figure 3:
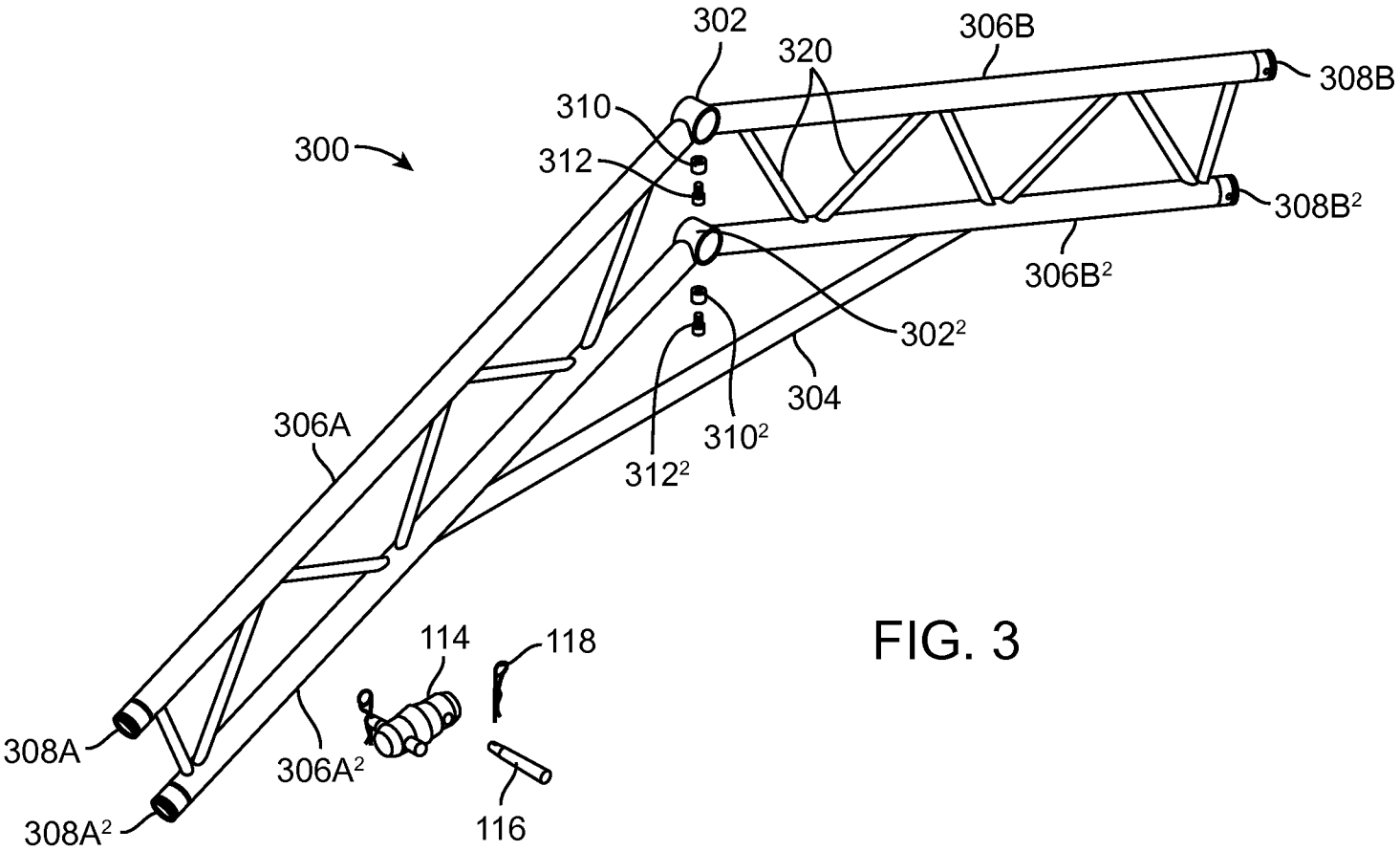
FIG. 3 illustrates a perspective view of a portable modular roof truss system, according to an embodiment of the present invention.

FIG. 3 illustrates a perspective view of a portable modular roof truss system 300, according to an embodiment of the present invention. The portable modular roof truss system 300 comprises two collars 302, 302$^2$, a crossbar 304, four arms 306A, 306A$^2$, 306B, 306B$^2$, four connecting members 308A, 308A$^2$, 308B, 308B$^2$, two locking mechanisms comprising a nut 310, 310$^2$, and bolt 312, 312$^2$, and a plurality of filler bars 320. The arms 306A, 306B, are elongated hollow cylinders coupled (e.g., welded) to opposing sides of the hollow cylindrical collar 302. Arms 306A$^2$, 306B$^2$, are elongated hollow cylinders coupled (e.g., welded) to opposing sides of the hollow cylindrical collar 302$^2$. The crossbar 304 is also an elongated cylinder residing parallel to the ground and is coupled (e.g., welded) to both arms 306A$^2$, 306B$^2$. Each hollow cylindrical connecting member 308A, 308B, 308A$^2$, 308B$^2$, is coupled (e.g., welded) to the end of an arm 306A, 306A$^2$, 306B, 306B$^2$, respectively. The nut 310 from the locking mechanism is coupled (e.g., welded) to the bottom portion of the collar 302 and interfaces an aperture in the collar 302 allowing the bolt 312 to pass through the nut 310 and into the hollow portion of the collar 302. Similarly, the nut 310$^2$ from the locking mechanism is coupled (e.g., welded) to the bottom portion of the collar 302$^2$ and interfaces an aperture in the collar 302$^2$ allowing the bolt 312$^2$ to pass through the nut 310$^2$ and into the hollow portion of the collar 302$^2$. Finally, the filler bars 320 are elongated hollow cylinders coupled (e.g., welded) to two arms 306A and 306A$^2$, or 306B and 306B$^2$.

Each connecting member 308A, 308A$^2$, 308B, and 308B$^2$ further comprises two apertures residing on opposite sides of the member perpendicular to the hollow portion thereof and used to couple the truss system 300 to a coupler 114. The connecting members 308A, 308A$^2$, 308B, and 308B$^2$ are capable of coupling to a variety of truss components (e.g., spacers, clamps, hinges, etc.).

For example, a coupler 114 may be inserted into the hollow portion of each connecting members 308A and 308A$^2$; a locking pin 116 may then be inserted through the apertures in the connecting members 308A and 308A$^2$ and in turn through an aperture in the coupler 114. In one embodiment, the locking pin 116 comprises a tapered cylinder with an aperture at smaller end capable of receiving a clasp 118. When the clasp 118 passes through the aperture in the locking pin 116, the coupler 114 is removably coupled to the portable modular roof truss system 300 at the connecting members 308A and 308A$^2$. The couplers 114 may further removably couple to additional truss components such as an I-beam truss segment 802 (FIG. 8).

Figure 4:
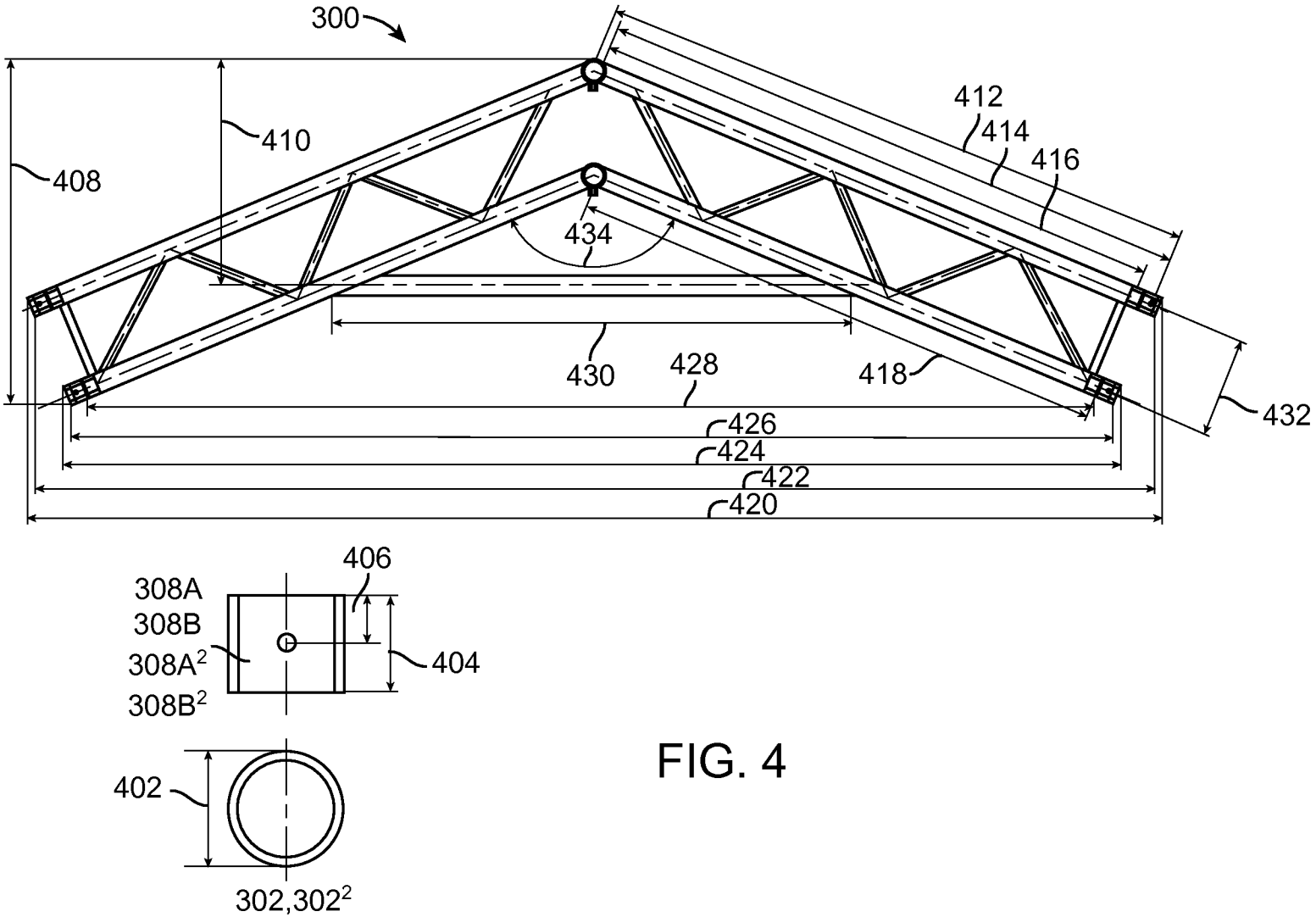
FIG. 4 illustrates a front view of the portable modular roof truss system, according to an embodiment of the present invention.

FIG. 4 illustrates a front view of a first portable modular roof truss system 300, according to an embodiment of the present invention. The collars of the truss system 300 have a diameter 402 between 46 cm to 56 cm, and preferably 51 cm. The four connecting members have a radius 406 between 20 cm to 30 cm, and preferably 25 cm, with a diameter 404 of preferably 50 cm. The height 408 of the truss system 300, when measured from the bottom edge of the connecting member to the top of the collar, is between 855 cm to 865 cm, and preferably 861.9 cm. The height 410 when measured from the center of the crossbar to the top of the collar is between 560 cm to 570 cm, and preferably 564.7 cm. The arms when coupled to connecting members and coupled to the top collar, as measured from the center of the top collar to the bottom edge of the connecting members, has a length 412 between 1525 cm to 1535 cm and preferably 1528.5 cm. The length 414 as measured from the top edge of the arms to the bottom edge of connector members is between 1508 cm to 1515 cm, and preferably 1511.7 cm. Length 416 of the arms alone is between 1457 cm and 1565 cm, and preferably 1461.7 cm. The length 418 of the bottom arms alone is between 1357 cm and 1365 cm, and preferably 1361.7 cm. The length 430 of the crossbar is between 1305 cm and 1312 cm, and preferably 1308 cm with a 1 cm delta. The width 420 of the portable modular roof truss system 300 as measured between top edges of the top connecting members is between 2834 cm and 2844 cm, and preferably 2839.6 cm. The width 422 of the portable modular roof truss system 300 as measured between bottom edges of the top connecting members is between 2795 cm to 2805 cm, and preferably 2799.5 cm. The width 424 of the portable modular roof truss system 300 as measured between top edges of the bottom connecting members is between 2650 cm to 2560 cm, and preferably 2655 cm. The width 426 of the portable modular roof truss system 300 as measured between bottom edges of the bottom connecting members is between 2615 cm to 2623 cm, and preferably 2618.8 cm. The width 428 of the portable modular roof truss system 300 as measured between bottom edges of the bottom arms is between 2520 cm and 2530 cm, and preferably 2525.4 cm. Additionally, the distance 432 between arms when measured from the midline is between 235 cm to 245 cm, and preferably 240 cm. Finally, the angle 434 as measured between the midline of both bottom arms and through the center of the bottom collar, is between 130° to 140°, and preferably 134.8°.

Figure 5:
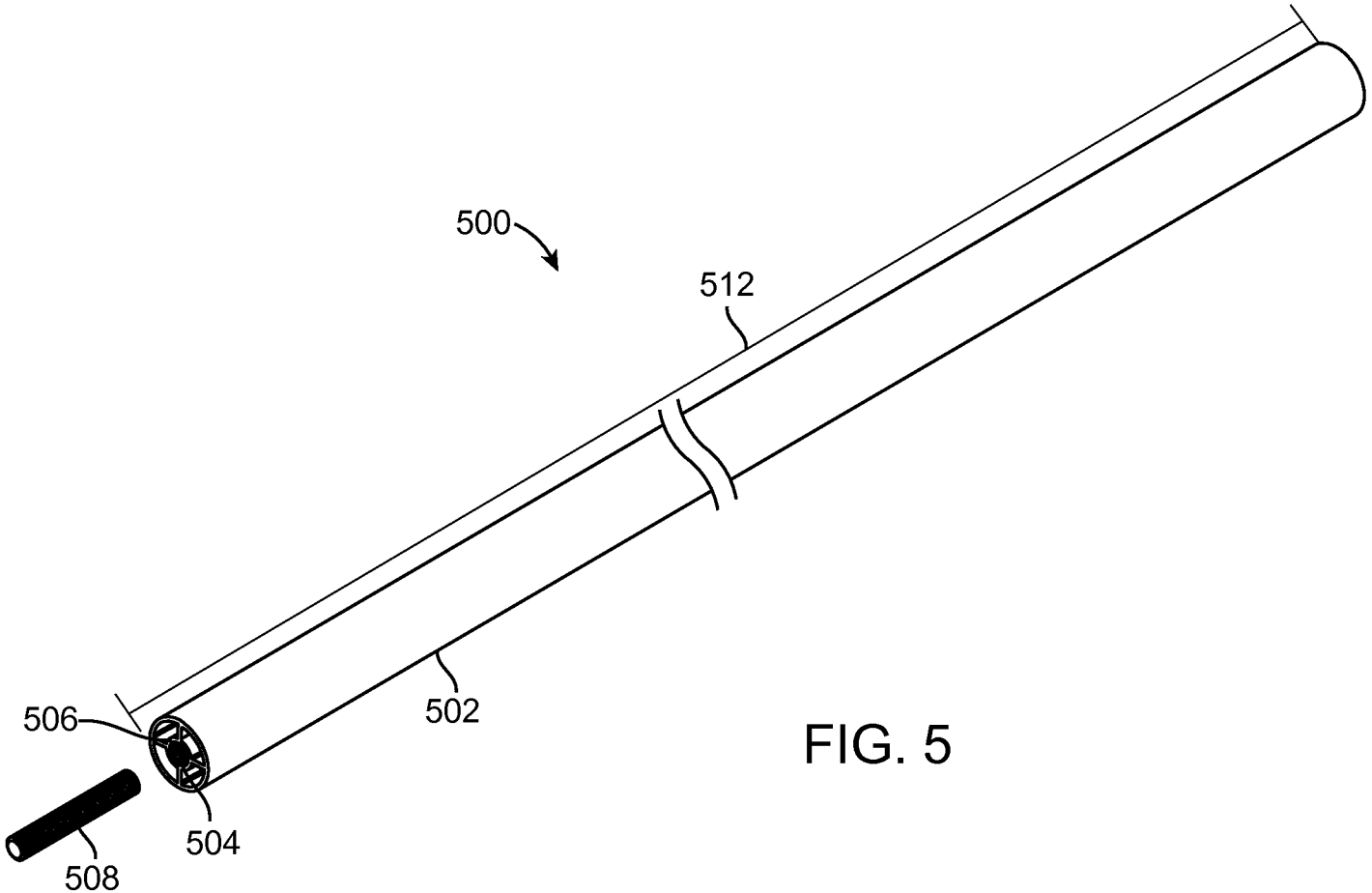
FIG. 5 illustrates a perspective view of a roof pole, according to an embodiment of the present invention.

FIG. 5 illustrates a perspective view of a roof pole 500, according to an embodiment of the present invention. The roof pole 500 of the preferred embodiment is constructed from two hollow diameter cylinders 502, 504, one within another. The two hollow cylinders are radially connected from the outside diameter of the inner cylinder 504 to the inside diameter of the outer cylinder 502 by four interconnecting radial tabs 506 which run the length of the pole 500. The inner diameter of the inner hollow cylinder 504 comprises threads to accept a bolt 508 to allow the roof poles 500 to connect one to the other and to expand the modular nature of the roof as long as is desired. The pole 500 may have a varying length 512 from 0.5 m, 1 m, 1.37 m, to 2 m. The wall thickness of the outer cylinder 502, inner cylinder 504, and radial tabs 506 is between 1 cm to 5 cm, and preferably 3 mm. Finally, the bolt 508 is preferably 16 mm in diameter. Finally, the roof pole 500 has a diameter between 45 cm to 55 cm, and preferably 50 cm.

Figure 6:
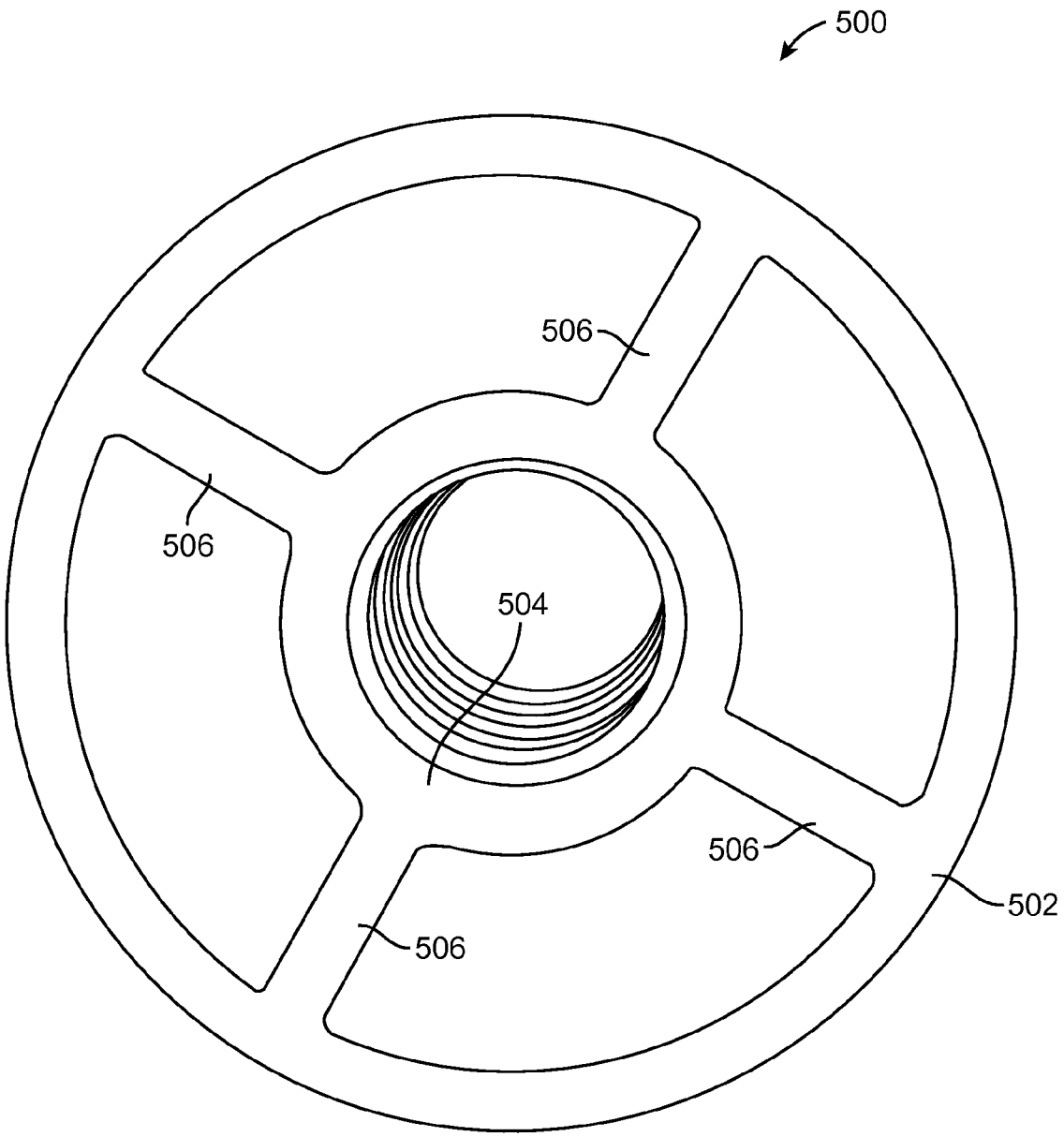
FIG. 6 illustrates a front view of the roof pole, according to an embodiment of the present invention.

FIG. 6 illustrates a front view of the roof pole 500, according to an embodiment of the present invention. This view exemplifies how the four interconnecting radial tabs 506 which run the length of the pole 500 radially connect the outer cylinder 502 and inner cylinder 504.

Figure 7:
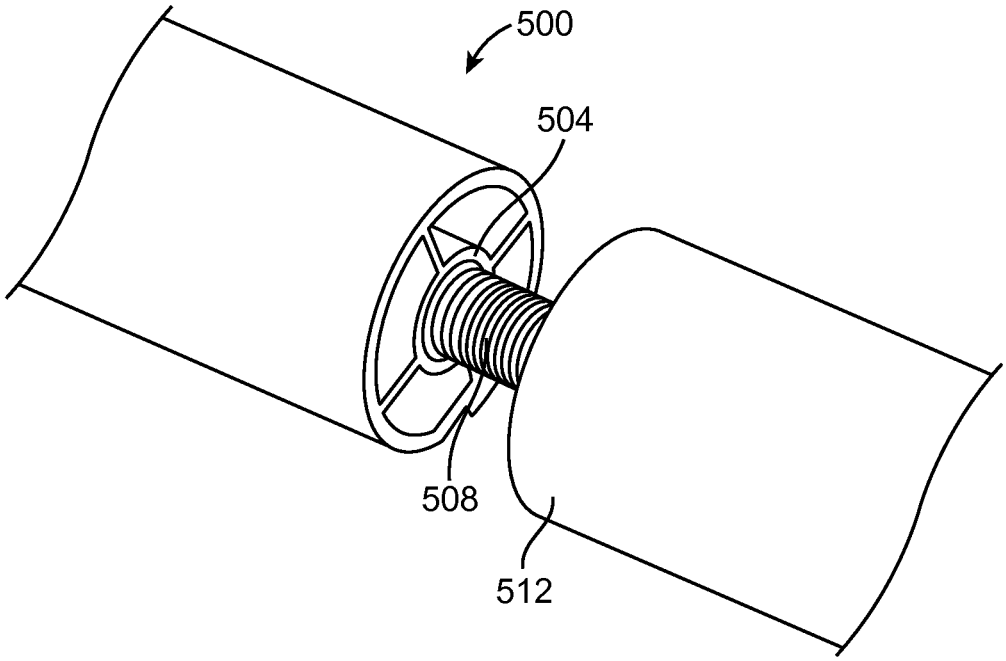
FIG. 7 illustrates two roof poles coupled together, according to an embodiment of the present invention.

FIG. 7 illustrates two roof poles 500, 512, coupled together, according to an embodiment of the present invention. In this view, the poles 500 and 512 are coupled together by utilizing the bolt 508 which engages threads residing in the inner cylinder 504 of pole 500. In an alternative embodiment, the roof poles 500 and 512 may be permanently coupled (e.g., welded) together.

FIG. 8 illustrates a view of assembled modular roof truss systems 100 and 100$^2$, according to an embodiment of the present invention. With respect to truss 100, the arms 106A, 106B, are coupled (e.g., welded) to opposing sides of the hollow cylindrical collar 102. The crossbar 104 resides parallel to the ground and is coupled (e.g., welded) to both arms 106A, 106B. Each connecting member 108A, 108B, is coupled (e.g., welded) to the end of an arm 106A, 106B, respectively. Finally, the locking mechanism is coupled (e.g., welded) to the bottom portion of the collar 102 and interfaces an aperture in the collar 102 allowing the bolt 112 to pass through the nut and into the hollow portion of the collar 102.

With respect to truss 100$^2$, the arms 106A$^2$, 106B$^2$, are coupled (e.g., welded) to opposing sides of the hollow cylindrical collar 102$^2$. The crossbar 104$^2$ resides parallel to the ground and is coupled (e.g., welded) to both arms 106A$^2$, 106B$^2$. Each connecting member 108A$^2$, 108B$^2$, is coupled (e.g., welded) to the end of an arm 106A$^2$, 106B$^2$, respectively. Finally, the locking mechanism is coupled (e.g., welded) to the bottom portion of the collar 102$^2$ and interfaces an aperture in the collar 102$^2$ allowing the bolt 112$^2$ to pass through the nut and into the hollow portion of the collar 102$^2$.

Locking members 108B and 108B$^2$ are removably coupled to an I-beam truss segment 802 as evidenced by locking pins 116 and clasps 118. Similarly, locking members 108A and 108A$^2$ are coupled to an I-beam truss segment 802 by use of locking pins 116 and clasps 118. A roof pole 500 passes through the hollow cylindrical collar 102 of the truss system 100. Said roof pole 500 may pass through a plurality of modular roof truss systems to create a roof of desired length. To ensure the roof pole 500 does not move back and forth through the collar 102, the bolt 112 is threaded through the collar 102 and pushes against the bottom of the roof pole 500. The top of the roof pole 500 in turn pushes against the collar 102 creating sufficient friction so the roof pole 500 cannot move laterally in relation to the collar 102.

Figure 9:
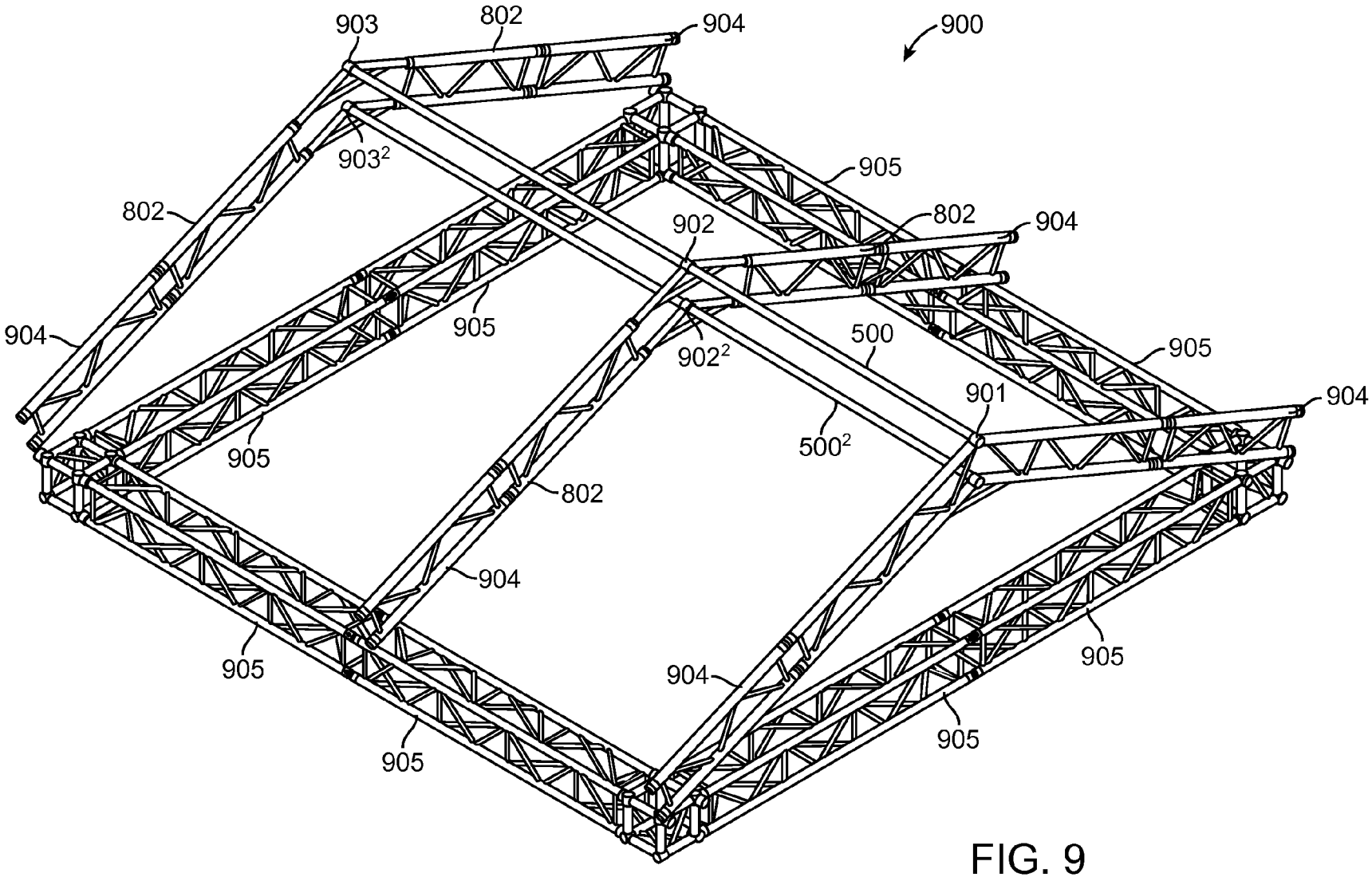
FIG. 9 illustrates an alternative view of assembled roof truss, according to an embodiment of the present invention.

Also exemplified in FIG. 8 is roof pole 500$^2$ passing through the hollow cylindrical collar 102$^2$ of the second truss system 100$^2$. Said roof pole 500$^2$ may also pass through a plurality of modular roof truss systems to create a roof of desired length. As with truss 100, to ensure the roof pole 500$^2$ does not move back and forth through the collar 102$^2$, the bolt 112$^2$ is threaded through the collar 102$^2$ and pushes against the bottom of the roof pole 500$^2$. The top of the roof pole 500$^2$ in turn pushes against the collar 102$^2$ creating sufficient friction so the roof pole 500$^2$ cannot move laterally. FIG. 9 illustrates an alternative view of assembled roof truss 900, according to an embodiment of the present invention. The assembled system 900 comprises truss system 901 and first modular roof truss systems 902, and 903. The system 900 further comprises second modular roof truss systems 902$^2$, and 903$^2$. Each pair of modular truss systems: 902 and 902$^2$; 903 and 903$^2$; are coupled to two I-beam truss segments 802, whereas truss system 901 couples to two secondary I-beam truss segments 904. Each I-beam truss segment 802 is further coupled a secondary I-beam truss segment 904. Finally, each secondary I-beam truss segment 904 is coupled to a square truss segment 905. Roof pole 500 passes through and connects the truss system 901 with first modular roof truss systems 902, and 903; while roof pole 500$^2$ passes through and connects the truss system 901 with the second modular roof truss systems 902$^2$, and 903$^2$.

The modular roof truss systems 901, 902, and 903, all being identical in shape provide a uniform slope for the assembled modular roof truss 900. In one embodiment of the present invention, fabric (e.g., spandex, cotton, etc.) is stretched over the first modular roof truss systems 901, 902, and 903, roof pole 500, and I-beam truss segments 802 and 904, to create a roof having symmetrical slopes. Each pair of modular truss systems: 902 and 902$^2$; 903 and 903$^2$; are interchangeable with the truss system 901, and vice versa.

Figure 10:
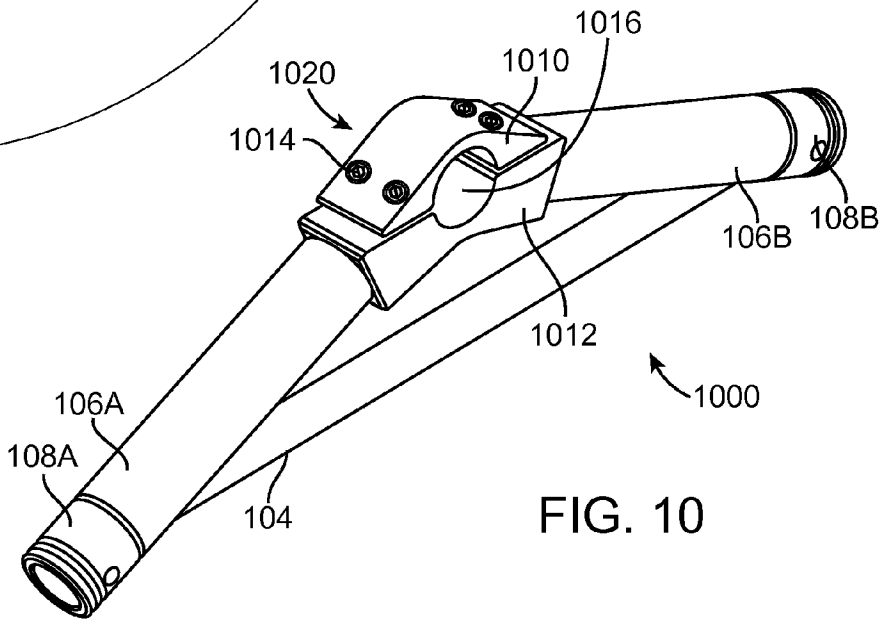
FIG. 10 illustrates a perspective view of a roof truss apex device, according to another embodiment of the present invention.

FIG. 10 illustrates a perspective view of a roof truss apex device 1000 in accordance with another embodiment of the invention. The device 1000 comprises a roof apex collar 1020, an elongated crossbar 104, two elongated hollow cylindrical arms 106A, 106B, and two hollow cylindrical connecting members 108A, 108B. The collar 1020 comprises a top member 1010 and a bottom member 1012.

The members 1010 and 1012 when coupled together form an opening 1016 for receiving a truss member. The members 1010 and 1012 can be coupled together by at least one bolt 1014. The bolt 1014 acts as a locking mechanism for the members 1010 and 1012 of collar 1020 to engage and hold in place a truss member, such as roof pole 500 (FIG. 12), maintained within the opening 1016 formed by the members 1010 and 1012 of collar 1020.

The arms 106A, 106B, are elongated hollow cylinders, the proximal end of each arm coupled (e.g., welded) to an opposing side of the bottom member 1012 at a predetermined slope. The crossbar 104 is also an elongated cylinder residing parallel to the ground and is coupled (e.g., welded) to both arms 106A, 106B. Each hollow cylindrical connecting member 108A, 108B, is coupled (e.g., welded) to the distal end of an arm 106A, 106B, respectively. Each connecting member 108A, 108B, further comprises two apertures residing on opposite sides of the member perpendicular to the hollow portion of the member used to couple the device 1000 to a coupler, such as coupler 114 in FIG. 1. The connecting members 108A, 108B, are capable of coupling to a variety of truss components/members (e.g., spacers, clamps, hinges, etc.). While the arms 106A, 106B, and crossbar 104 mentioned herein are cylindrical in shape, the arms 106A, 106B, and/or crossbar 104 may have different profiles such as elliptical, rectangular, etc., or combinations thereof. Similarly, the opening 1016 formed when the top and bottom members 1010 and 1012 are coupled together, can be elliptical, rectangular, etc., to accommodate different truss component profiles.

Figure 11:
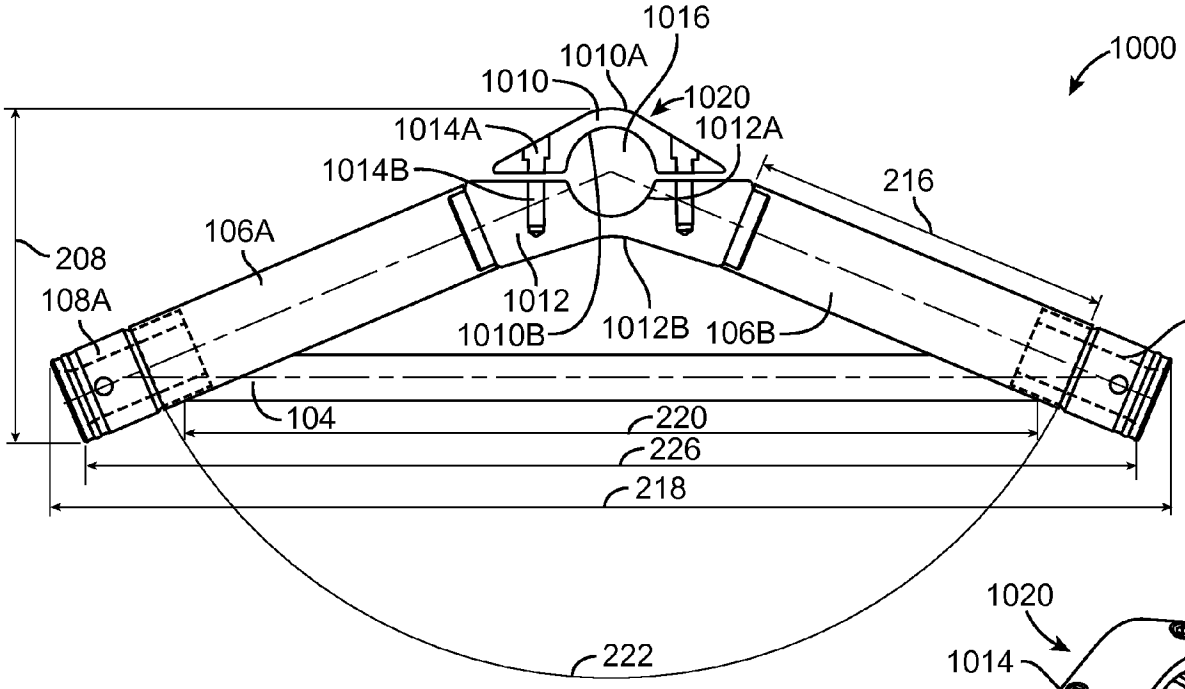
FIG. 11 illustrates a front view of a roof truss apex device, according to another embodiment of the present invention.

FIG. 11 illustrates a side/front view of the roof truss apex device 1000, according to another embodiment of the invention. In this embodiment, the top member 1010 of collar 1020 comprises a top substantially convex surface 1010A and a bottom substantially semi-cylindrical concave surface 1010B. The top member 1010 further comprises at least one countersunk hole 1014A located at a distal end of the top surface 1010A capable of receiving the bolt 1014 (FIG. 10). The bottom member 1012 of collar 1020 comprises a top substantially semi-cylindrical concave surface 1012A and a bottom substantially concave surface 1012B. The concave surface 1012A and the concave surface 1010B, form said opening 1016 in the collar 1020 when the members 1010 and 1012 are coupled together as shown in FIGS. 10 and 11.

The bottom member 1012 further comprises at least one countersunk hole 1014B located at a distal end of the top surface 1012A, capable of receiving the bolt 1014 inserted through the countersunk hole 1014A when countersunk holes 1014A and 1014B are aligned. The bolt 1014 is countersunk within the top surface 1010A of the top member 1010 such that it does not protrude above the top surface 1010A.

In one example, the height 208 of the device 1000, when measured from the bottom edge of the connecting member 108A to the top of the collar 1020, is about 186.8 cm. The length 220 of the crossbar 104 is about 482 cm. The length 216 of the arm 106B alone is about 205.0 cm. The width 226 of the device 1000, as measured between the bottom edges of the connecting members 108A, 108B, is about 596.5 cm. The width 218 of the device 1000, as measured between the top edges of the connecting members 108A, 108B, is about 636.5 cm. Finally, the angle 222, as measured between the midline of both connecting members 108A, 108B, and through the center of the collar 1020, is about 134.8°.

Figure 12:
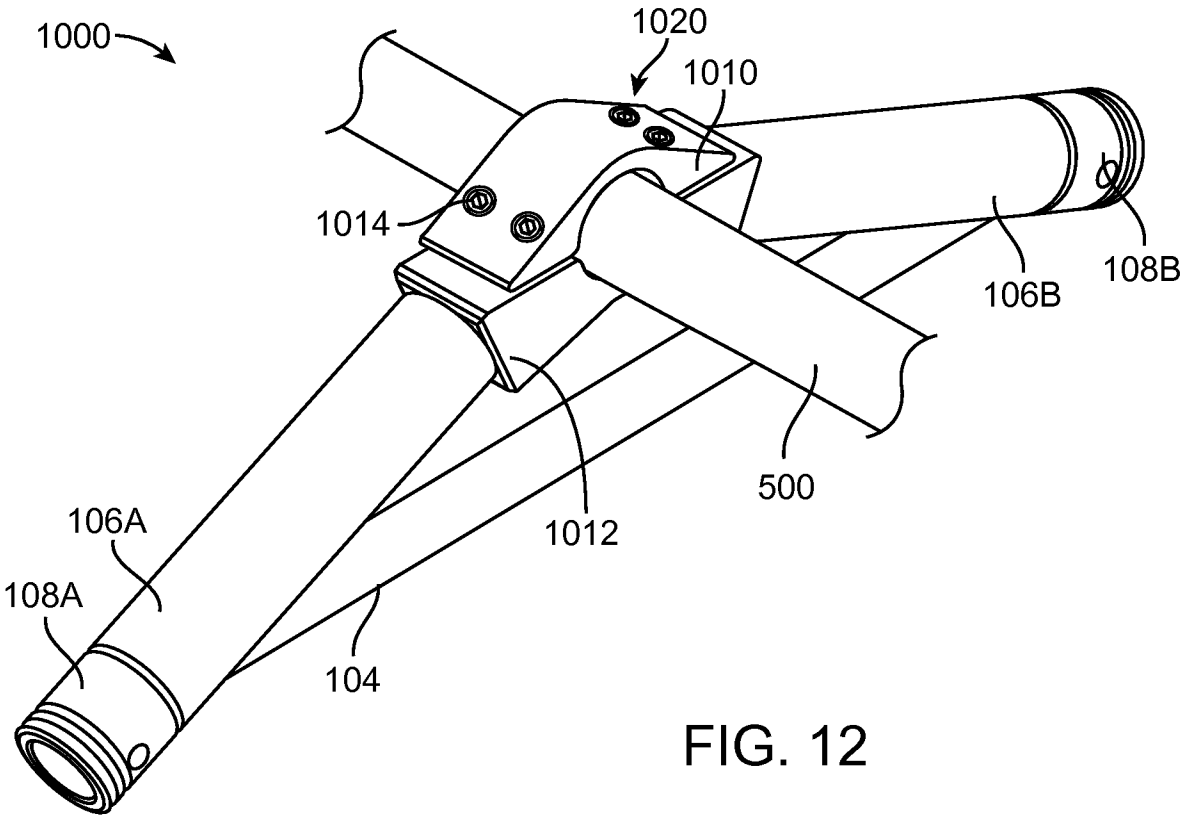
FIG. 12 illustrates a perspective view of a roof truss apex device, according to another embodiment of the present invention.

FIG. 12 illustrates a perspective view of a roof truss apex device 1000, according to another embodiment of the present invention. In this figure, the roof pole 500 passes through the opening 1016 (FIG. 10) in the assembled collar 1020 of the device 1000. To engage and prevent the roof pole 500 residing within the collar 1020 from moving back and forth, the top member 1010 is coupled to the bottom member 1012 by at least one bolt 1014. As each bolt 1014 is tightened, the top member 1010 is urged against the top of the roof pole 500. The bottom of the roof pole 500 in turn is urged against the bottom member 1012, creating sufficient friction so that the roof pole 500 cannot move laterally in relation to the collar 1020.

Figure 13:
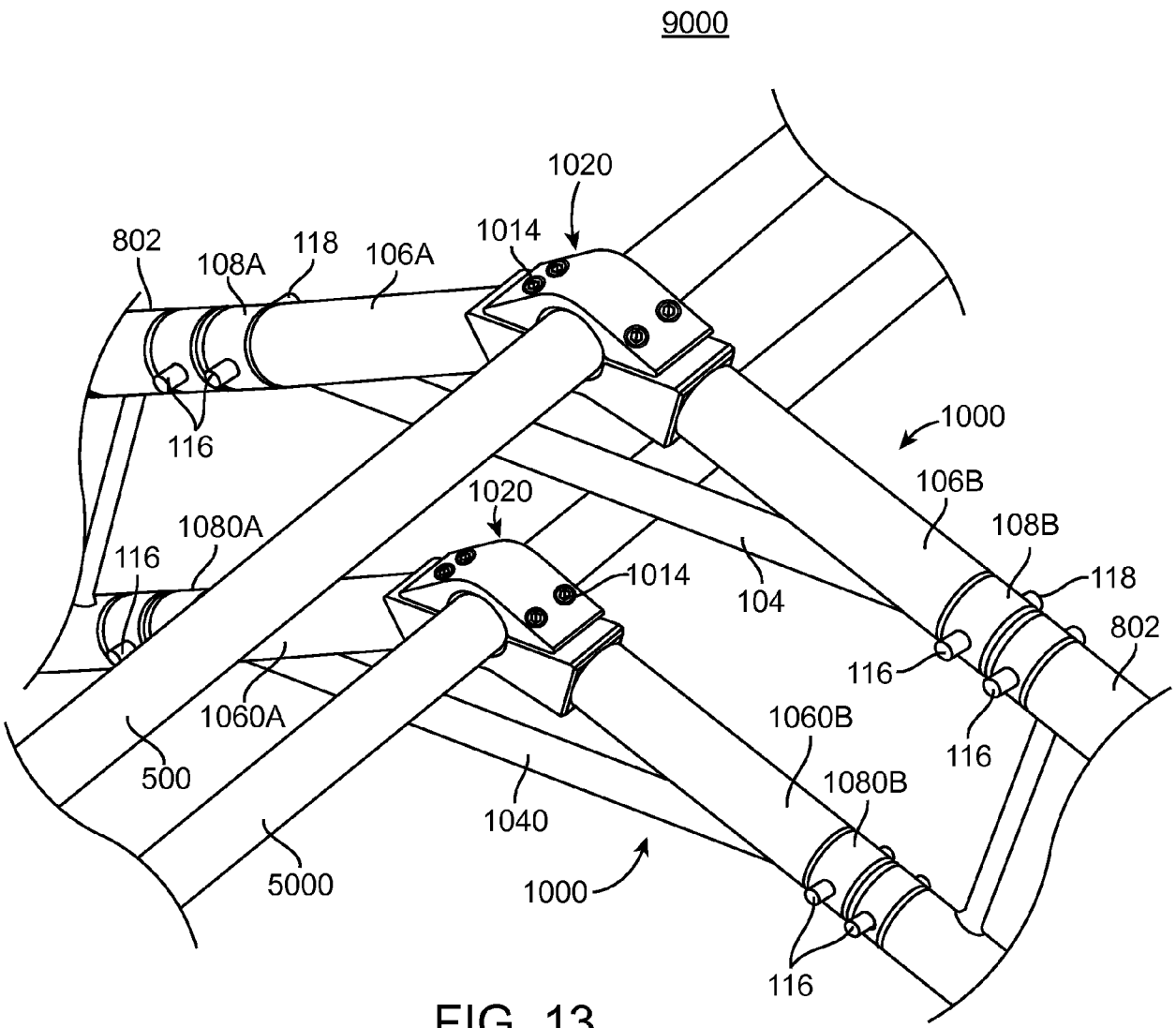
FIG. 13 illustrates a top perspective view of a portable modular roof truss system, according to another embodiment of the present invention.

In another embodiment the present invention provides a portable modular roof truss system 9000 as shown in FIG. 13. The system 9000 comprises multiple roof truss apex devices.

Specifically, FIG. 13 illustrates a top perspective view of portable modular roof truss system 9000 comprising a first roof truss apex device 1000 and second roof truss apex device 1000, engaging at least one truss segment 802 which maintains the two devices 1000 at fixed distance in relation to one another. In one example a truss segment 802 comprises an I-beam comprises two parallel truss members connected via connecting beams (filler bars) transverse to both parallel truss members. In this example, the first device 1000 is located spatially above the second device 1000, as shown in FIG. 13.

With respect to the first device 1000, a first set of elongated hollow cylindrical arms 106A, 106B, are coupled (e.g., welded), by the proximal end, to opposing sides of a roof apex collar 1020 of the first device 1000 (i.e. first roof apex collar 1020). A first elongated crossbar 104 resides parallel to the ground and is coupled (e.g., welded) to the first set of arms 106A, 106B. A first set of hollow cylindrical connecting members 108A, 108B, is coupled (e.g., welded) to the distal end of the first set of arms 106A, 106B, respectively.

With respect to the second device 1000, a second set of elongated hollow cylindrical arms 1060A, 1060B, are coupled (e.g., welded), by the proximal end, to opposing sides of a roof apex collar 1020 of the second device 1000 (i.e. second roof apex collar 1020). A second elongated crossbar 1040 resides parallel to the ground and is coupled (e.g., welded) to the second set of arms 1060A, 1060B. A second set of hollow cylindrical connecting members 1080A, 1080B, is coupled (e.g., welded) to the distal end of the second set of arms 1060A, 1060B, respectively.

Connecting members 108B and 1080B are removably coupled to an I-beam truss segment 802 as evidenced by locking pins 116 and clasps 118. Similarly, connecting members 1080A and 1080A are coupled to an I-beam truss segment 802 by use of locking pins 116 and clasps 118.

Also exemplified in FIG. 13 is a first roof pole 500 passing through the first roof apex collar 1020 of the first device 1000, and a second roof pole 5000 passing through the second roof apex collar 1020 of the second device 1000. Said roof poles 500 and 5000 may pass through a plurality of modular roof truss systems 9000 to create a roof of desired length.

Figure 14:
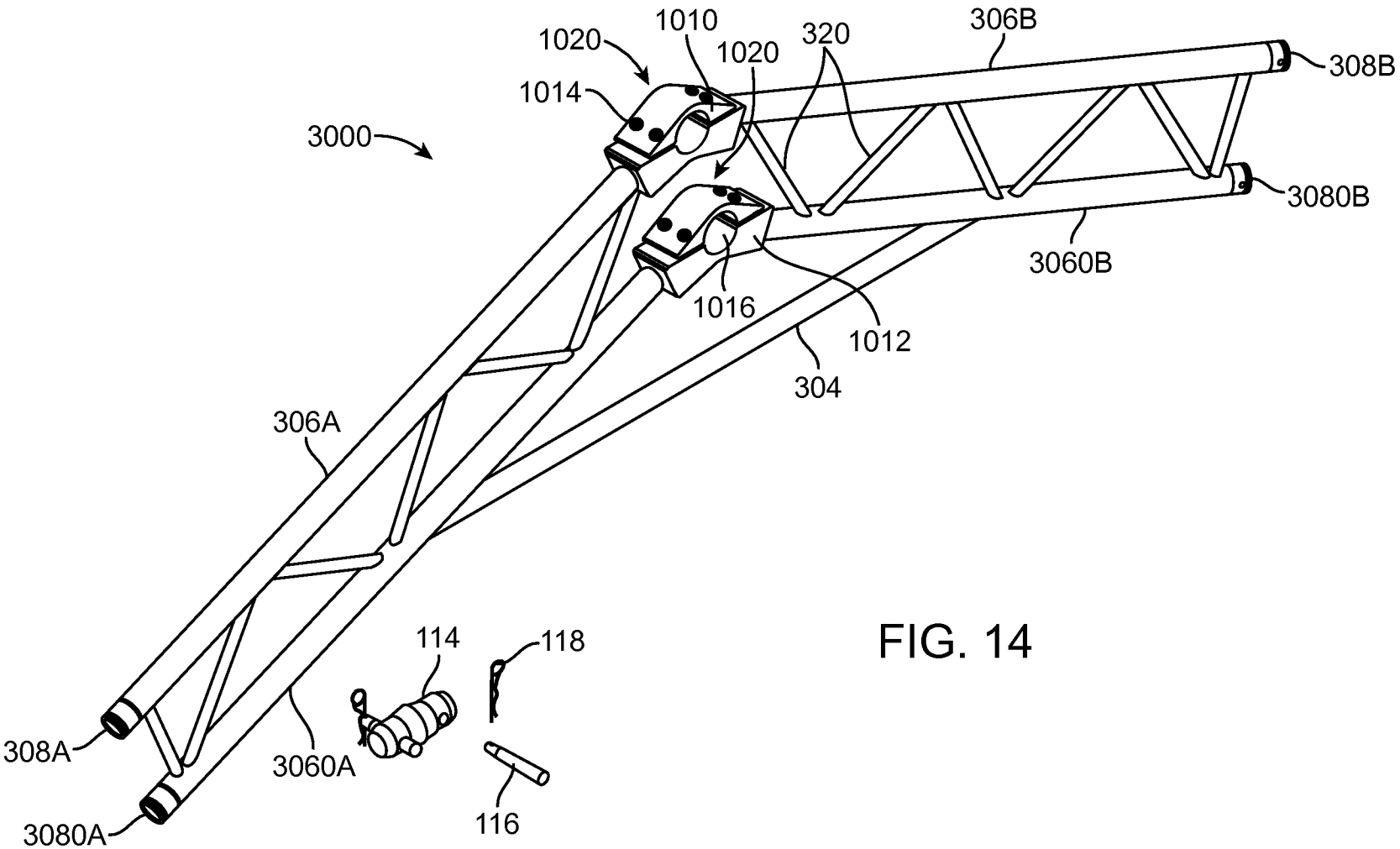
FIG. 14 illustrates a top perspective view of a portable modular roof truss system, according to another embodiment of the present invention.

FIG. 14 illustrates a perspective view of a portable modular roof truss system 3000, according to another embodiment of the present invention. The portable modular roof truss system 3000 comprises a first roof apex collar 1020, a second roof apex collar 1020, an elongated crossbar 304, four elongated hollow cylindrical arms 306A, 3060A, 306B, 3060B, four hollow cylindrical connecting members 308A, 3080A, 308B, 3080B, and a plurality of filler bars 320. The filler bars 320 are transverse to the arms 306A, 3060A, 306B, 3060B. Similar to roof poles 500 and 5000 in FIG. 13, a first roof pole can pass through the first roof apex collar 1020, and a second roof pole can pass through the second roof apex collar 1020.

The arms 306A, 306B, are elongated hollow cylinders coupled (e.g., welded), by the proximal end, to opposing sides of the first roof apex collar 1020. The arms 3060A, 3060B, are elongated hollow cylinders coupled (e.g., welded) to opposing sides of the second roof apex collar 1020. The crossbar 304 is also an elongated cylinder and is coupled (e.g., welded) to both arms 3060A, 3060B. Each hollow cylindrical connecting member 308A, 308B, 3080A, 3080B, is coupled (e.g., welded) to the distal end of an arm 306A, 3060A, 306B, 3060B, respectively. Finally, the filler bars 320 are elongated hollow cylinders capable of being coupled (e.g., welded) to either arms 306A and 3060A, or arms 306B and 3060B.

Each connecting member 308A, 3080A, 308B, and 3080B further comprises two apertures residing on opposite sides of the member perpendicular to the hollow portion thereof and used to couple the truss system 300 to a coupler 114. The connecting members 308A, 3080A, 308B, and 3080B are capable of coupling to a variety of truss components (e.g., spacers, clamps, hinges, etc.) For example, a coupler 114 may be inserted into the hollow portion of each connecting members 308A and 3080A. A locking pin 116 may then be inserted through the apertures in the connecting members 308A and 3080A and in turn through an aperture in the coupler 114. In one embodiment, the locking pin 116 comprises a tapered cylinder with an aperture at smaller end capable of receiving a clasp 118. When the clasp 118 passes through the aperture in the locking pin 116, the coupler 114 is removably coupled to the portable modular roof truss system 3000 at the connecting members 308A and 3080A. The couplers 114 may further removably couple to additional truss components such as an I-beam truss segment 802 (FIG. 8).

Figure 15:
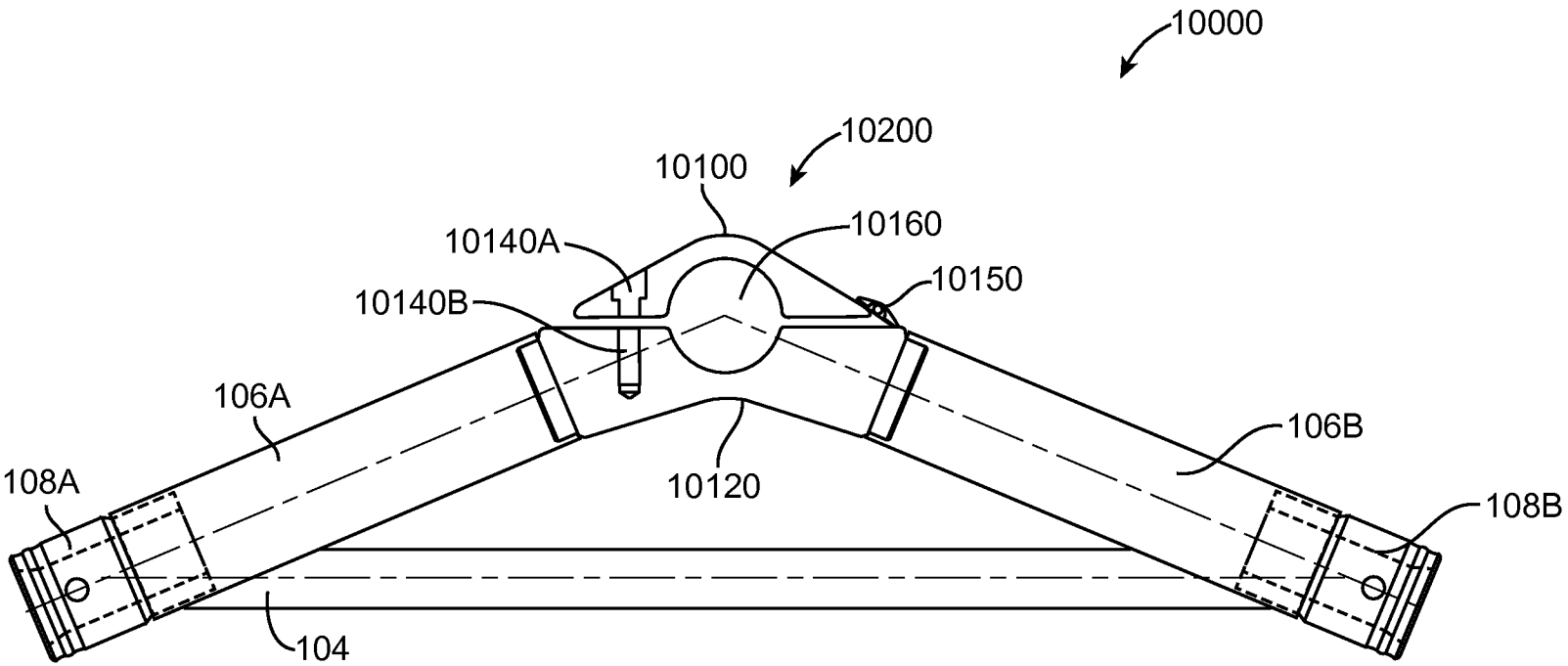
FIG. 15 illustrates a front view of a roof truss apex device, according to another embodiment of the present invention.

FIG. 15 illustrates a front/side view of a roof truss apex device 10000, according to another embodiment of the invention. Device 10000 comprises a roof apex collar 10200, an elongated crossbar 104, two elongated hollow cylindrical arms 106A, 106B, two hollow cylindrical connecting members 108A, 108B, and a hinge 10150. The collar 10200 comprises a top member 10100 and a bottom member 10120. The members 10100 and 10120 when coupled together form an opening 10160 for receiving a truss member, such as roof pole 500 (FIG. 12).

A hinge 10150 couples the top member 10100 to the bottom member 10120. Top member 10100 is capable of pivoting about the hinge 10150 in a direction perpendicular to a roof pole 500 (FIG. 12) residing within the collar 10200.

At least one bolt 1014 can further couple the top member 10100 and the bottom member 10120 The top member 10100 comprises at least one countersunk hole 10140A capable of receiving the bolt 1014. The bottom member 10120 comprises at least one countersunk hole 10140B, wherein countersunk hole 10140B is capable of receiving the bolt 1014 inserted through the countersunk hole 10140A when countersunk holes 10140A and 10140B are aligned. The bolt 1014 is countersunk within the top member 10100 such that it does not protrude above the top member 10100. The hinge 10150 and bolt 1014 act as a locking mechanism for the members 10100 and 10120 of collar 10200 to engage and hold in place a truss member, such as roof pole 500 (FIG. 12), maintained within the opening 10160 formed by the members 10100 and 10120 of collar 10200.

The elements of the modular roof truss systems 100 (FIG. 1), 200 (FIG. 2), 300 (FIG. 3), 3000 (FIG. 14), 9000 (FIG. 13) and roof truss apex devices 1000 (FIG. 10), 10000 (FIG. 15) may be made of rigid materials such as metals and the like. Preferably, the elements of the modular roof truss systems 100 (FIG. 1), 200 (FIG. 2), 300 (FIG. 3), 3000 (FIG. 14), 9000 (FIG. 13) and roof truss apex devices 1000 (FIG. 10), 10000 (FIG. 15) comprise extruded aluminum.

The present invention has been described in considerable detail with reference to certain preferred versions thereof; however, other versions are possible. Therefore, the spirit and scope of the appended claims should not be limited to the description of the preferred versions contained herein.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

What is claimed is:

1. A roof truss apex device, comprising:

a roof apex collar comprising:

a top member including a top surface that comprises a substantially convex surface;

a bottom member; and a locking mechanism to couple the top member to the bottom member to form an opening in the collar, wherein the opening is configured for receiving a truss member;

a first elongated arm with a proximal end coupled to the bottom member of the collar; and a second elongated arm with a proximal end coupled to the bottom member of the collar, wherein the first and second arms are transverse in relation to one another and slope downwardly away from the collar;

wherein the device is configured for engaging two truss segments sloping downwards away from the collar;

wherein the opening is shaped to accommodate a profile of the truss member;

wherein the locking mechanism comprises at least one bolt that couples the top member to the bottom member of the collar to engage and maintain in place the truss member within the opening;

wherein the top member further comprises;

a bottom surface; and at least one countersunk hole located at a distal end of the top surface configured for receiving the bolt; and wherein the botom surface is a substantially semi-cylindrial concave surface configured for both receiving and supporting walls of the truss member.

2. The roof truss apex device of claim 1, further comprising:

an elongated crossbar transversely coupled to the first arm and the second arm.

3. The roof truss apex device of claim 2, further comprising:

a first hollow connecting member coupled to a distal end of the first arm; and a second hollow connecting member coupled to a distal end of the second arm;

wherein the first and second connecting members are configured for receiving and engaging an I-beam truss segment.

4. The roof truss apex device of claim 1, wherein the bottom member comprises:

a top surface;

a bottom surface; and at least one countersunk hole configured for receiving the bolt and residing in a plane both parallel to and directly below the countersunk hole of the top member;

wherein the top surface is a substantially semi-cylindrical concave surface configured for both receiving and supporting walls of the truss member;

wherein the bottom surface is a substantially concave surface.

5. The roof truss apex device of claim 4, wherein the bolt is countersunk within the top surface of the top member, remaining flush with the top surface of the top member when coupling the top member to the bottom member.

6. The roof truss apex device of claim 1, wherein the top member further comprises at least one countersunk hole located at a distal end of the top surface.

7. A portable modular roof truss system, comprising:

a first roof truss apex device, comprising:

a first roof apex collar comprising:

a first top member including a top surface comprising a substantially convex surface;

a first bottom member; and a first locking mechanism to couple the first top member to the first bottom member to form a first opening in the collar, wherein the first opening is configured for receiving a first truss member;

a first elongated arm with a proximal end coupled to the first bottom member of the first collar; and a second elongated arm with a proximal end coupled to the first bottom member of the first collar, wherein the first and second arms are transverse in relation to one another and slope downwardly away from the first collar;

wherein the first device is configured for engaging two truss segments sloping downwards away from the first collar;

wherein the first opening is shaped to accommodate a profile of the first truss member;

wherein the first device further comprises:

a first elongated crossbar transversely coupled to the first arm and the second arm, and residing in a plane both parallel to the ground and below the first collar;

a first hollow connecting member coupled to a distal end of the first arm; and a second hollow connecting member coupled to a distal end of the second arm;

wherein the first and second connecting members are configured for receiving and engaging an I-beam truss segment; and a second roof truss apex device residing in a plane both parallel to and below the first roof truss apex device, comprising:

a second roof apex collar comprising:

a second top member;

a second bottom member; and a second locking mechanism to couple the second top member to the second bottom member to form a second opening in the second collar, wherein the second opening is configured for receiving a second truss member;

a third elongated arm with a proximal end coupled to the second bottom member of the second collar; and a fourth elongated arm with a proximal end coupled to the second bottom member of the second collar, wherein the third and fourth arms are transverse in relation to one another and slope downwardly away from the second collar;

wherein the second device is configured for engaging two truss segments sloping downwards away from the second collar; and wherein the second opening is shaped to accommodate the profile of the second truss member.

8. The system of claim 7, wherein the second device further comprises:

a second elongated crossbar transversely coupled to the third arm and the fourth arm, and residing horizontally below the second collar;

a third hollow connecting member coupled to a distal end of the third arm; and a fourth hollow connecting member coupled to a distal end of the fourth arm;

wherein the third and fourth connecting members are configured for coupling to the I-beam truss segment.

9. The system of claim 8, wherein the first, second, third and fourth hollow connecting members, the first, second, third and fourth arms, and the first and second elongated crossbars are cylindrical in shape.

10. The system of claim 7, wherein the second truss member resides in a plane both parallel to and directly below the first truss member.

11. The system of claim 7, wherein the first truss member and the second truss member reside in a plane perpendicular to the first device and the second device.

12. The system of claim 7, wherein:

the third arm resides in a plane both parallel to and directly below the first arm; and the fourth arm resides in a plane both parallel to and directly below the second arm.

13. A portable modular roof truss system, comprising:

a first roof apex collar comprising:

a first top member including a top surface comprising a substantially convex surface;

a first bottom member; and a first locking mechanism to couple the first top member to the first bottom member to form a first opening in the first collar, wherein the first opening is configured for receiving a first truss member;

a first elongated arm with a proximal end coupled to the first bottom member of the first collar; and a second elongated arm with a proximal end coupled to the first bottom member of the first collar, wherein the first and second arms are transverse and slope downwards away from the first collar;

wherein the system is configured for engaging two truss segments sloping downwards away from the first collar; and wherein the first opening is shaped to accommodate a profile of the first truss member; and a second roof apex collar residing in a plane both parallel to and below the first roof apex collar, comprising:

a second top member;

a second bottom member; and a second locking mechanism to couple the second top member to the second bottom member to form a second opening in the second collar, wherein the second opening is configured for receiving a second truss member;

a third elongated arm with a proximal end coupled to the second bottom member of the second collar; and a fourth elongated arm with a proximal end coupled to the second bottom member of the second collar, wherein the third and fourth arms are transverse and slope downwards away from the second collar;

wherein the system is configured for engaging two truss segments sloping downwards away from the second collar; and wherein the second opening is shaped to accommodate the profile of the second truss member.

14. The system of claim 13, further comprising:

an elongated crossbar transversely coupled to the third arm and the fourth arm, and residing horizontally below the second collar;

a first hollow connecting member coupled to a distal end of the first arm;

a second hollow connecting member coupled to a distal end of the second arm;

a third hollow connecting member coupled to a distal end of the third arm; and a fourth hollow connecting member coupled to a distal end of the fourth arm;

wherein the first, second, third and fourth hollow connecting member are configured for receiving and engaging an I-beam truss segment.

15. The system of claim 14, further comprising:

a plurality of filler bars, wherein each of the plurality of filler bars is coupled to the first arm and the third arm, and arranged in a zig zag pattern between the first arm and the third arm.

16. The system of claim 14, further comprising:

a plurality of filler bars, wherein each of the plurality of filler bars is coupled to the second arm and the fourth arm, and arranged in a zig zag pattern between the second arm and the fourth arm.

17. The system of claim 14, wherein the first, second, third and fourth hollow connecting members, the first, second, third and fourth arms, and the first and second elongated crossbars are cylindrical in shape.

18. A roof truss apex device, comprising:

a roof apex collar comprising:

a top member including a top surface comprising a substantially convex surface;

a bottom member;

a locking mechanism to couple the top member to the bottom member to form an opening in the collar, wherein the opening is configured for receiving a truss member;

a first elongated arm with a proximal end coupled to the bottom member of the collar; and a second elongated arm with a proximal end coupled to the bottom member of the collar, wherein the first and second arms are transverse in relation to one another and slope downwardly away from the collar;

wherein the device is configured for engaging two truss segments sloping downwards away from the collar;

wherein the opening is shaped to accommodate a profile of the truss member; and wherein the locking mechanism comprises a hinge that couples the top member to the bottom member of the collar to engage and maintain in place the truss member within the opening.

19. The roof truss apex device of claim 18, further comprising:

an elongated crossbar transversely coupled to the first arm and the second arm.

20. The roof truss apex device of claim 19, further comprising:

a first hollow connecting member coupled to a distal end of the first arm; and a second hollow connecting member coupled to a distal end of the second arm;

wherein the first and second connecting members are configured for receiving and engaging an I-beam truss segment.

21. The roof truss apex device of claim 18, wherein the locking mechanism further comprises at least one bolt that couples the top member to the bottom member of the collar to engage and maintain in place the truss member within the opening.

22. The roof truss apex device of claim 21, wherein:

the top member comprises at least one countersunk hole capable of receiving the bolt; and the bottom member comprises at least one countersunk hole configured for receiving the bolt, and residing in a plane both parallel to and directly below the countersunk hole of the top member.

23. The roof truss apex device of claim 22, wherein the bolt is countersunk within the top member, remaining flush with the top member when coupling the top member to the bottom member.

* * * * *